United States Patent [19]

Hamilton et al.

[11] Patent Number: 4,502,309

[45] Date of Patent: Mar. 5, 1985

[54] METHOD OF REMOVING FORMED PARTS FROM A DIE

[75] Inventors: Charles H. Hamilton, Thousand Oaks; Paul R. Puhaczewski, Torrance, both of Calif.

[73] Assignee: Rockwell International Corporation, El Segundo, Calif.

[21] Appl. No.: 481,559

[22] Filed: Apr. 4, 1983

Related U.S. Application Data

[63] Continuation-in-part of Ser. No. 151,497, May 19, 1980, Pat. No. 4,381,657.

[51] Int. Cl.[3] ..... B21D 26/04

[52] U.S. Cl. ..... 72/60; 72/342; 72/345; 72/364; 72/427

[58] Field of Search ..... 72/60, 342, 345, 364, 72/427

[56] References Cited

U.S. PATENT DOCUMENTS

| | | | |
|---|---|---|---|
| 3,101,021 | 8/1963 | Johnson | 83/152 X |
| 3,654,796 | 4/1972 | Dunn | 72/345 |
| 4,043,168 | 8/1977 | Muzurel | 72/345 |
| 4,181,000 | 1/1980 | Hamilton | 72/60 |
| 4,381,657 | 5/1983 | Hamilton | 72/345 |

*Primary Examiner*—Leon Gilden

*Attorney, Agent, or Firm*—Charles T. Silberberg

[57] ABSTRACT

A method of removing a formed part from a die, said part produced by clamping a preform between first and second dies, bringing said preform to within an elevated temperature range suitable for superplastic forming of said preform, and applying pressure to said preform to superplastically form at least a portion of said preform into a cavity of said first die, comprising the steps of:

drawing a vacuum between at least a portion of said part and said second die such that said part is secured to said second die; and separating said second die from said first die while said part is within said temperature range and secured to said second die, such that said part is withdrawn from said cavity of said first die.

4 Claims, 5 Drawing Figures

METHOD OF REMOVING FORMED PARTS FROM A DIE

This application is a CIP of application Ser. No. 06/151,497 filed 5/19/80, now U.S. Pat. No. 4,381,657.

BACKGROUND OF INVENTION

1. Field of Invention

The invention relates to the field of metal forming, and particularly to an improved method of removing a formed part from a die cavity.

2. Background of Prior Art

Removal of formed parts from a die can be difficult, particularly if the part is formed at high temperatures and is to be removed from the die while still hot. For example, when superplastically forming titanium parts, as disclosed in U.S. Pat. No. 4,181,000, Method for Superplastic Forming by Hamilton, et al., the forming temperatures are around 1600° F. During superplastic forming, the preform is clamped between two dies and stretched into the form of the cavity in one of the dies. Considerable friction forces develop and after forming it is often difficult to remove the part. A typical procedure is to use a crowbar, or the like, to pry the formed part out of the die. This can create problems because if the part is still at high temperatures, and thus possessing little resistance to deformation, the localized loading may warp the part making it unusable. This is especially true with large parts that have been formed in dies having near to zero cavity draft angles. On the other hand, if the part is allowed to cool, so will the die, making the production rate exceedingly low and, additionally, wasting a lot of energy reheating the die. Additionally, differential shrinkage between the part and die can lead to destruction or the "locking" of the part therein.

The other most commonly used method is to mechanically eject. For example, U.S. Pat. No. 3,535,766, Machine Assembly Method by L. Jymes, and U.S. Pat. No. 3,642,415, Plunger-and-Diaphragm Plastic Sheet Forming Apparatus by H. G. Johnson and U.S. Pat. No. 3,587,144, Multi-Sections Mold with Air Pressure Ejecting Ring by E. H. Mechling use pneumatically driven plungers to eject the formed part from the die.

The problem with mechanical ejection by use of pins or the like is that it also creates localized loading which may deform the part, again, particularly if the part is at high temperature. There is also a problem of maintaining the pin flush with the cavity wall so that no localized discontinuities are created on the part.

One of the most common methods of ejecting a formed part from a die cavity is to use pneumatic pressure. Typically, one or more ports are provided in the die cavity so that air can be injected between the part and cavity to eject the part. Examples of pneumatic ejection systems can be found in U.S. Pat. No. 3,952,991, Apparatus for Ejecting a Workpiece from a Mold Cavity by Schneider; U.S. Pat. No. 3,556,650, Diaphragm-Type Sheet Forming Method by H. G. Johnson. With the use of pneumatic ejection, localized loading may also occur but is less prevalent. Having a port in the cavity wall may also create unacceptable localized discontinuities in the part. Furthermore, the use of gas may cause localized cooling of the part and die causing distortion.

Another method used to remove parts from a die is the use of vacuum cups. For example, U.S. Pat. No. 3,179,262, Material Transferring Apparatus by Carlson, et al., discloses the use of a conveyor system having vacuum cups for transferring material from one press to another. This method has several disadvantages. For example, it requires a separate system for removing the part. The vacuum cup would have to be at least as large as the part. If it were made smaller, then the problem of localized loading would appear which could cause undesirable deformation. Thus, for large parts the vacuum cup and its supports, etc., would become large and expensive. Furthermore, a specific vacuum cup would have to be fabricated for each part. This would also add to the expense.

Therefore, it is a primary object of this invention to provide an improved method of removing formed parts from a die cavity.

It is another object of this invention to provide a method of removing formed parts from a die that will minimize distortion of the part as it is removed from the die cavity.

A further object of the this invention is to provide a method for removing formed parts from a die cavity which does not require that discontinuities exist in the cavity wall.

A still further object of this invention is to provide a method of removing formed parts from a die without requiring substantial cooling of the die.

SUMMARY OF THE INVENTION

The invention is a method for removing a part from a die, the part being produced by clamping a preform between first and second dies and forming at least a portion of the preform into a cavity of the first die. The method comprises the steps of drawing a vacuum between the formed preform and the second die and separating the second die from the first die such that the part is withdrawn from the cavity of the first die. In a preferred embodiment, wherein the part is clamped about its periphery, the method includes the additional steps of providing a channel about at least a portion of the second die aligned with and in communication with the periphery of the preform, and providing sealing members to seal off the channel. The vacuum is drawn from the channel. If the method of forming is superplastic forming, a port is provided in the second die adapted to couple pressurized fluid to the portion of the preform to be superplastically formed and the vacuum is applied through the port.

The novel features which are believed to be characteristic of the invention, both as to its organization and its method of operation, together, with further objects and advantages thereof, will be better understood from the following description in connection with the accompanying drawings in which a presently preferred embodiment of the invention is illustrated by way of example. It is to be expressly understood, however, that the drawings are for purposes of illustration and description only, and are not intended as a definition of the limits of the invention.

DESCRIPTION OF PREFERRED EMBODIMENTS

The removal of parts from dies after undergoing substantial deformation can be difficult because during the forming operation a substantial amount of frictional force is developed between the die and part. A good example where this occurs is in superplastic forming (hereafter abbreviated as "SPF").

A number of metals, for example alloys of titanium, zirconium, and aluminum, exhibit the property of developing unusually high tensile elongations with a reduced tendency toward local necking during deformation at elevated temperatures. This property is called superplasticity. The SPF process is discussed in detail in U.S. Pat. No. 3,934,441, Controlled Environment Superplastic Forming of Metals by C. H. Hamilton, et al., incorporated into this specification herewith by reference.

Simplified, the process involves placing a preform, typically in the form of a metal sheet, over a cavity in a first die and clamping it in place by a second die. The blank is then heated to a temperature where it exhibits superplasticity, after which fluid pressure is applied to the blank causing it to stretch and form into a cavity. Thus, it is easy to see that considerable friction forces are developed which must be overcome if the part is to be removed from the cavity.

Figure 1:
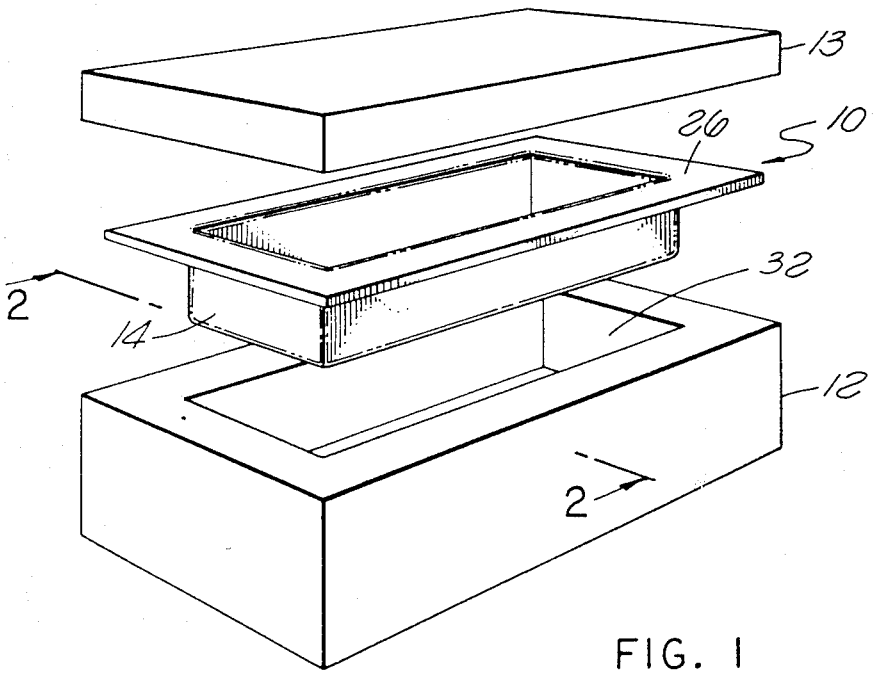
FIG. 1 is an exploded perspective view of a rectangular shaped part and upper and lower dies.

Illustrated in FIG. 1 is an exploded perspective view of a rectangular-shaped part 10, which is typical of parts which can be manufactured by SPF, and its lower and upper dies 12 and 13, respectively. Part 10 comprises a cup portion 14 and a flat flange portion 26. The die 12 has a cavity 32 which has a shape complementary to the cup portion 14, and a top surface 34 conforming to the flange portion 26 of the part 10.

Figure 2:
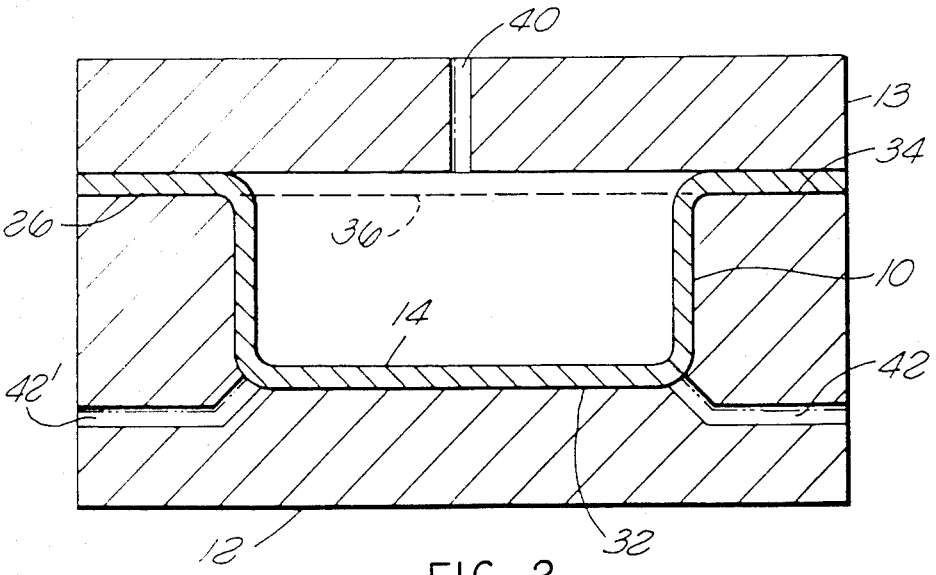
FIG. 2 is a cross-sectional view of the assembled dies containing the completed part.

Still referring to FIG. 1, and additionally to FIG. 2, which is a cross-sectional view of the dies 12 and 13 along the lines 2—2 (shown in FIG. 1), it can be seen that a preform 36 (shown in phantom) used to make the part 10 is initially in the form of a flat sheet. After the preform 36 is heated to a temperature where it exhibits superplasticity, pressurized inert gas from a source (not shown) is applied through port 40. A vacuum is typically drawn from ports 42 and 42' in the die 12 by means of a pump (not shown) or the gas in the die cavity is just vented to atmosphere. This causes the preform 36 to expand into the cavity 32. The pressure applied through port 40 is returned to ambient and the vacuum drawn through ports 42 and 42' is terminated.

Figure 3:
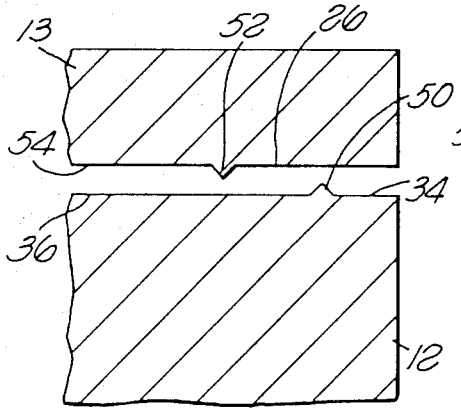
FIG. 3 is an enlarged view of a portion of the dies shown in FIG. 2 illustrating a preferred sealing method to seal off the preform from the ambient environment.

If the preform is made of materials such as titanium, which are subject to contamination, it is important that the preform be sealed from ambient air. FIG. 3 is an enlarged view of the portion of FIG. 2 illustrating a method of sealing off the preform 36. A protrusion 50 is provided on surface 34 of the die 12 and a second protrusion 52 is provided on surface 54 of the die 13. When the die 13 is clamped in place (by means not shown), the protrusions engage the preform 36 causing high localized loading which effectively produce seals. Typically, the portion of the flange 26 of the part 10 outward of the protrusion 50 is trimmed off and the indentations caused by the protrusions are allowable. If all of the flange 26 is to be retained, alternate methods, such as flat gaskets (not shown) or o-rings in grooves (not shown) on the surfaces 34 and 50 of the dies 12 and 13, respectively, may be used.

The improved method for removing the part from the cavity 32 of the die 12 is as follows: (1) a vacuum is drawn through port 40 by means of a pump (not shown). This causes the completed part 10 to be securely forced against surface 54 of the die 13 and secured thereto; (2) the die 13 is then lifted upward pulling the part 10 out of the cavity 32 of the die 12 without producing any abnormal local loading which would distort the part. This method has the advantage of requiring no additional hardware for removal other than that necessary for SPF, such as ejection pins.

Figure 3A:
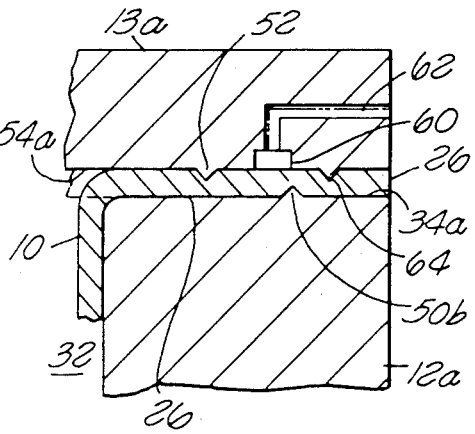
FIG. 3*a* illustrates an alternate method of applying a vacuum between the upper die and the part.
Figure 4:
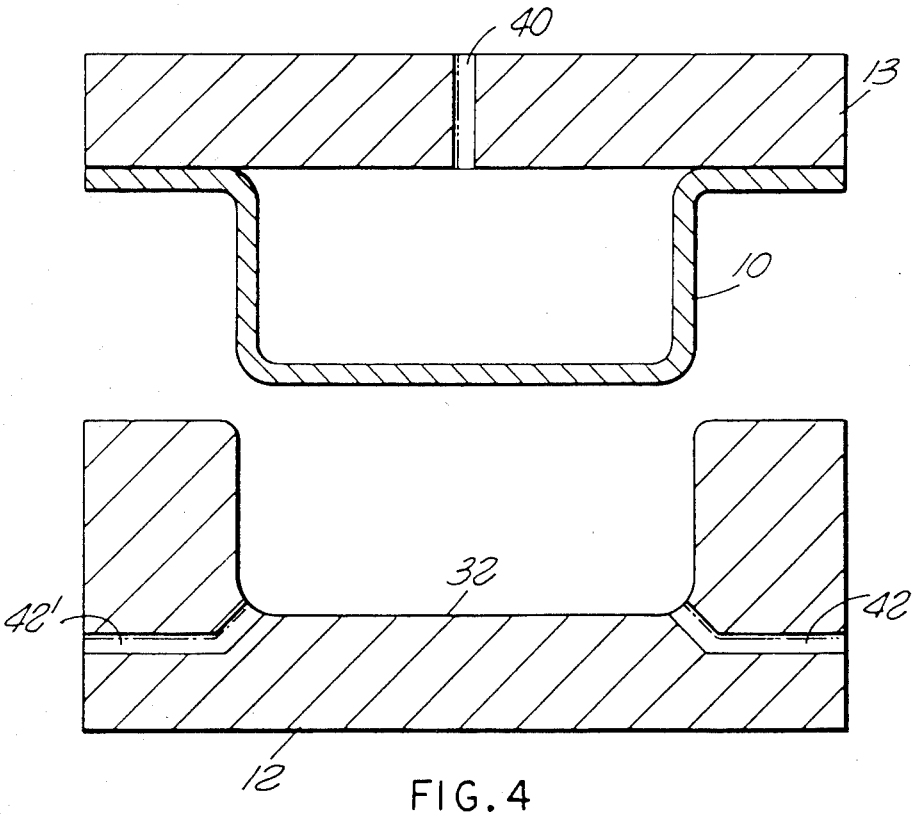
FIG. 4 illustrates the upper die and formed part separated from the lower die.

Illustrated in FIG. 3*a* is an alternate method of applying the vacuum to a part 10*a*. The die 12*a* has a protrusion 50*b* on the surface 34*a*, while die 13*a* has a protrusion 52*a* on its surface 54*a*. A channel 60 is provided which runs around at least a portion of and preferably completely around and periphery of the die 13*a*. The channel 60 is coupled to port 62. A second protrusion 64 is provided, which runs completely around the periphery of the die 13*a* outside of the channel 60, and, thus, the channel 60 is sealed off from the cavity 32 and the external ambient environment. For removal of the part 10 under these conditions, a vacuum is drawn at port 62 which effectively seals the completed part 10*a* to the die 13*a* and removal is accomplished as before by lifting the die 13*a* upward.

In both embodiments disclosed, it may be desirable, when forming by SPF, to allow the part to cool slightly so that it is out of the SPF temperature range prior to removal from the die. At SPF, the part is easily deformed, especially if the part is thin. This will prevent any localized loading upon removal (for example, part of the flange portion 26 being deformed into channel 60 when the vacuum is drawn). Since the SPF temperature range is relatively small, the dies will not lose much heat. Preferably the cooling should be no greater than about 200° F. lower than the minimum superplastic forming temperature in order to assure ease of removal of the part, i.e., the part tends to lock into the forming tool as it becomes more rigid due to the cooling, and to maintain ecomony (time and cost to reheat for forming of additional parts).

While the disclosure has been directed at the removal of parts from dies in the SPF process, it is also applicable to the superplastic forming/diffusion bonding process, for example U.S. Pat. No. 3,927,817, Method For Making Metallic Sandwich Structures by C. H. Hamilton et al.

Having thus described the invention, it is obvious that numerous modifications and departures may be made by those skilled in the art; thus, the invention is to be construed as being limited only by the spirit and scope of the appended claims.

What is claimed is:

1. A method of removing a formed part from a die, said part produced by clamping a preform between first and second dies, bringing said preform to within an elevated temperature range suitable for superplastic forming of said preform, and applying pressure to said preform to superplastically form at least a portion of said preform into a cavity of said first die, comprising the steps of:

drawing a vacuum between at least a portion of said part and said second die such that said part is secured to said second die; and separating said second die from said first die while said part is within said temperature range and secured to said second die, such that said part is withdrawn from said cavity of said first die.

2. The method of claim 1 wherein said preform is clamped at its periphery and further including the steps of:

providing a channel about at least a portion of said second die aligned with and in communication with said periphery of said preform, said vacuum being drawn through said channel; and providing a pair of sealing members, one on each side of said channel, such that said sealing members seal off said channel when said preform is clamped between said first and second dies.

3. A method of removing a formed part from a die, said part produced by clamping a preform between first and second dies, bringing said preform to within a first elevated temperature range suitable for superplastic forming of said preform, and applying pressure to said preform to superplastically form at least a portion of said preform into a cavity of said first die, comprising the steps of:

cooling said formed part to within a second elevated temperature range which is less than that suitable for superplastic forming of said preform, the lowest temperature of said second temperature range being no more than about 200° F. below the lowest temperature of said first temperature range;

drawing vacuum between at least a portion of said part and said second die while said part is within said second temperature range such that said part is secured to said second die; and separating said second die from said first die while said part is secured to said second die and within said second temperature range such that said part is withdrawn from said cavity of said first die.

4. The method of claim 3 wherein said preform is clamped at its periphery and further including the steps of:

providing a channel about at least a portion of said second die aligned with and in communication with said periphery of said preform, said vacuum being drawn through said channel; and providing a pair of sealing members, one on each side of said channel, such that said sealing members seal off said channel when said preform is clamped between said first and second dies.

* * * * *